US006856949B2

(12) United States Patent
Singh et al.

(10) Patent No.: US 6,856,949 B2
(45) Date of Patent: Feb. 15, 2005

(54) WEAR COMPENSATED ROLLER CONE DRILL BITS

(75) Inventors: Amardeep Singh, Houston, TX (US); Sujian Huang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/443,196

(22) Filed: May 22, 2003

(65) Prior Publication Data

US 2003/0196835 A1 Oct. 23, 2003

Related U.S. Application Data

(63) Continuation of application No. 09/775,530, filed on Jan. 31, 2001, now Pat. No. 6,619,444.

(51) Int. Cl.[7] ..... G06G 7/48; E21B 12/02; E21B 10/16

(52) U.S. Cl. ..... 703/7; 175/39; 175/40; 175/426

(58) Field of Search ..... 175/40, 39, 57, 175/331, 374, 426, 428, 431, 433, 434; 703/7

(56) References Cited

U.S. PATENT DOCUMENTS

| | | | | | |
|---|---|---|---|---|---|
| 3,727,705 | A | * | 4/1973 | Newman | 175/374 |
| 4,189,012 | A | * | 2/1980 | Garrett | 175/312 |
| 4,627,276 | A | * | 12/1986 | Burgess et al. | 175/39 |
| 4,815,342 | A | * | 3/1989 | Brett et al. | 700/159 |
| 4,845,628 | A | * | 7/1989 | Gray et al. | 702/9 |
| 5,613,093 | A | * | 3/1997 | Kolb | 345/473 |
| 5,715,899 | A | * | 2/1998 | Liang et al. | 175/374 |
| 5,787,022 | A | * | 7/1998 | Tibbitts et al. | 702/12 |
| 5,794,720 | A | * | 8/1998 | Smith et al. | 175/40 |
| 5,813,480 | A | * | 9/1998 | Zaleski et al. | 175/40 |
| 5,813,485 | A | * | 9/1998 | Portwood | 175/430 |
| 6,021,859 | A | * | 2/2000 | Tibbitts et al. | 175/431 |
| 6,095,262 | A | * | 8/2000 | Chen | 175/374 |
| 6,109,368 | A | * | 8/2000 | Goldman et al. | 175/39 |
| 6,164,390 | A | * | 12/2000 | Murdock et al. | 175/24 |
| 6,213,225 | B1 | * | 4/2001 | Chen | 175/331 |
| 6,374,926 | B1 | * | 4/2002 | Goldman et al. | 175/39 |
| 6,386,297 | B1 | * | 5/2002 | Cooley et al. | 175/39 |
| 6,412,577 | B1 | * | 7/2002 | Chen | 175/57 |
| 6,619,411 | B2 | * | 9/2003 | Singh et al. | 175/57 |
| 6,785,641 | B1 | * | 8/2004 | Huang | 703/7 |
| 2001/0037902 | A1 | * | 11/2001 | Chen | 175/431 |

FOREIGN PATENT DOCUMENTS

| | | | | | |
|---|---|---|---|---|---|
| GB | 2360304 | A | * | 9/2001 | E21B/3/00 |
| WO | WO 00/12860 | A3 | * | 3/2000 | E21B/10/16 |

* cited by examiner

*Primary Examiner*—David Bagnell
*Assistant Examiner*—Jennifer H Gay
(74) *Attorney, Agent, or Firm*—Osha & May L.L.P.

(57) ABSTRACT

A method for designing a drill bit that has at least one roller cone and a plurality of cutting elements, including selecting initial bit design parameters. Drilling simulations are then used to determine wear, and the simulated drill bit is changed to reflect the determined wear. Then, at least one design parameter is adjusted. The simulation, determination, change of the simulated drill bit, and adjustment may be repeated until at least one performance parameter of the drill bit is optimized. A drill bit can be designed using such a method.

39 Claims, 4 Drawing Sheets

WEAR COMPENSATED ROLLER CONE DRILL BITS

CROSS REFERENCE TO RELATED APPLICATIONS

This application is a continuation of and claims the benefit, pursuant to 35 U.S.C.§ 120, U.S. patent application Ser. No. 09/775,530 filed on Jan. 31, 2001, now U.S. Pat. No. 6,619,411.

BACKGROUND OF THE INVENTION

Roller cone drill bits are commonly used in the oil and gas industry for drilling wells. FIG. 1 shows one example of a roller cone drill bit used in a conventional drilling system for drilling a well bore in an earth formation. The drilling system includes a drilling rig 10 used to turn a drill string 12 which extends downward into a wellbore 14. Connected to the end of the drill string 12 is a roller cone-type drill bit 20.

As shown in FIG. 2, roller cone bits 20 typically comprise a bit body 22 having an externally threaded connection at one end 24, and at least one roller cone 26 (usually three as shown) attached at the other end of the bit body 22 and able to rotate with respect to the bit body 22. Disposed on each of the cones 26 of the bit 20 are a plurality of cutting elements 28 typically arranged in rows about the surface of the cones 26. The cutting elements 28 can be tungsten carbide inserts, polycrystalline diamond inserts, boron nitride inserts, or milled steel teeth. If the cutting elements 28 are milled steel teeth, they may be coated with a hardfacing material.

When a roller cone bit is used to drill earth formations, the bit may experience abrasive wear. Abrasive wear occurs when hard, sharp formation particles slide against a softer surface of the bit and progressively remove material from the bit body and cutting elements. The severity of the abrasive wear depends upon, among other factors, the size, shape, and hardness of the abrasive particles, the magnitude of the stress imposed by the abrasive particles, and the frequency of contact between the abrasive particles and the bit.

Abrasive wear may be subclassified in to three categories: low-stress abrasion, high-stress abrasion, and gouging abrasion. Low-stress abrasion occurs when forces acting on the formation are not high enough to crush abrasive particles. Comparatively, high-stress abrasion occurs when forces acting on the formation are sufficient to crush the abrasive particles. Gouging abrasion occurs when even higher forces act on the formation and the abrasive particles dent or gouge the bit body and/or the cutting elements of the bit.

As a practical matter, all three abrasion mechanisms act on the bit body and cutting elements of drill bits. The type of abrasion may vary over different parts of the bit. For example, shoulders of the bit may only experience low-stress abrasion because they primarily contact sides of a wellbore. However, a drive row of cutting elements, which are typically the cutting elements that first contact a formation, may experience both high-stress and gouging abrasion because the cutting elements are exposed to high axial loading.

Drill bit life and efficiency are of great importance because the rate of penetration of the bit through earth formations is related to the wear condition of the bit. Accordingly, various methods have been used to provide abrasion protection for drill bits in general, and specifically for roller cones and cutting elements. For example, roller cones, cutting elements, and other bit surfaces have been coated with hardfacing material to provide more abrasion resistant surfaces. Further, specialized cutting element insert materials have been developed to optimize longevity of the cutting elements. While these methods of protection have met with some success, drill bits still experience wear.

As a bit wears, its cutting profile can change. One notable effect of the change in cutting profile is that the bit drills a smaller diameter hole than when new. Changes in the cutting profile and in gage diameter act to reduce the effectiveness and useful life of the bit. Other wear-related effects that are less visible also have a dramatic impact on drill bit performance. For example, as individual cutting elements experience different types of abrasive wear, they may wear at different rates. As a result, a load distribution between roller cones and between cutting elements may change over the life of the bit. The changes may be undesirable if, for example, a specific roller cone or specific rows of cutting elements are exposed to a majority of axial loading. This may cause further uneven wear and may perpetuate a cycle of uneven wear and premature bit failure.

For the foregoing reasons, there exists a need for an effective method of improving the wear characteristics of drill bits, and specifically of roller cone drill bits. The design of the bits should be such that the wear experienced over the life of the bit does not cause drilling inefficiency or early failure of the drill bit.

SUMMARY OF THE INVENTION

One aspect of the invention is a drill bit comprising a bit body, at least one roller cone attached to the bit body and able to rotate with respect to the bit body, and a plurality of cutting elements disposed on the at least one roller cone. At least one bit design parameter is selected so that the cutting elements wear in a selected manner when drilling an earth formation.

In another aspect, the invention is a method for optimizing a design of a drill bit comprising at least one roller cone and a plurality of cutting elements. The method comprises selecting initial bit design parameters and simulating drilling at least one selected earth formation. Wear induced changes in cutting element geometries are determined and the simulated bit is adjusted to reflect the wear. The selecting, simulating, determining, and adjusting are repeated and at least one bit design parameter is adjusted until at least one drill bit performance parameter is optimized.

Other aspects and advantages of the invention will be apparent from the following description and the appended claims.

DETAILED DESCRIPTION

Figure 1:
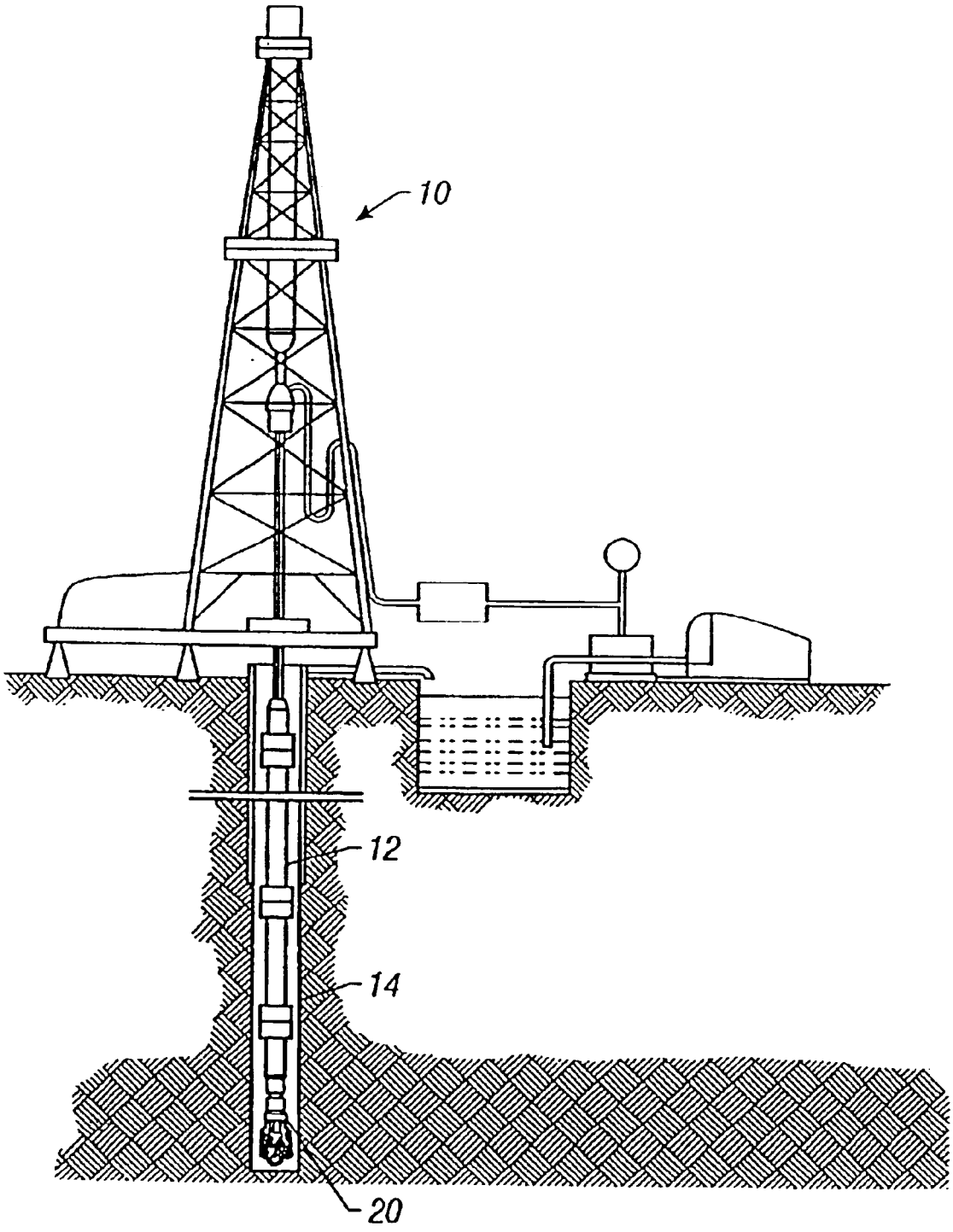
FIG. 1 (Prior Art)
FIG. 1 shows a roller cone drill bit used in a conventional drilling system.
Figure 2:
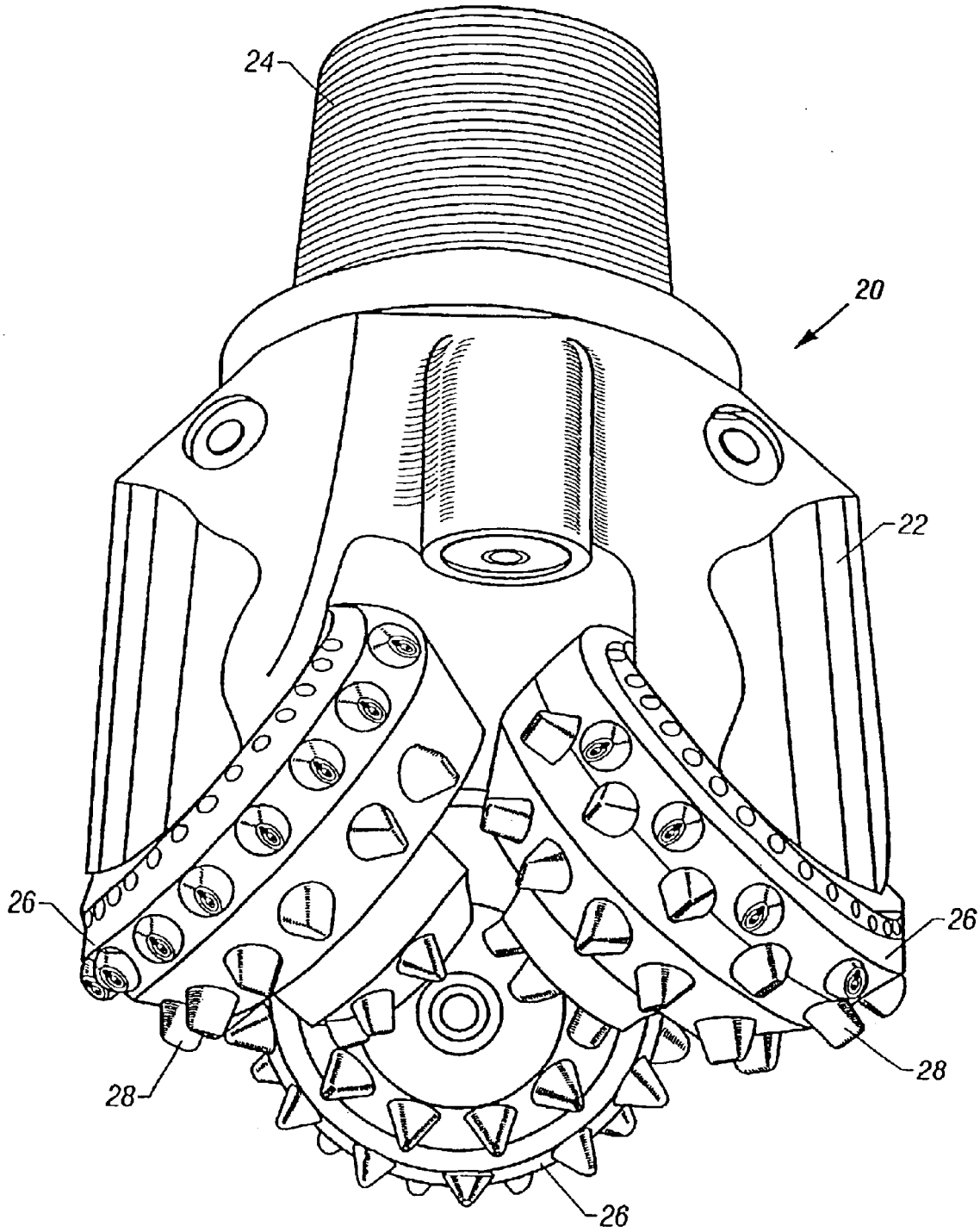
FIG. 2 (Prior Art)
FIG. 2 shows an expanded view of a roller cone drill bit.

In order to account for the effect of abrasive wear on roller cone drill bit performance, the abrasive wear mechanism must be analyzed. After a detailed analysis, bit design parameters may be modified to minimize or compensate for abrasive wear. Therefore, a model of the abrasive wear mechanism has been designed and is described in detail below.

Modeling Abrasive Wear

In an embodiment of the invention, abrasion of material from a drill bit that is drilling a wellbore may be analogized to a single point machining operation. At any point on the bit, the action of a single abrasive particle may be observed and analyzed. For example, a single abrasive particle may cut a furrow into a surface of the bit and remove material. The size of the abrasive particle determines if the cutting action is on a macroscopic or microscopic scale.

The volume of wear produced by the single abrasive particle may be expanded to incorporate the effects of a large number of abrasive particles acting over a selected area of the drill bit. In an embodiment of the invention, a volume of wear per unit time may be described by equation (1):

$$W=(K)(N)(V)(t) \quad (1)$$

where W is the wear volume per unit time due to abrasion, N is the number of abrasive particles in contact with the selected area of the drill bit at a selected time interval t, and V is the relative sliding velocity between the selected area of the drill bit and the abrasive particles at the point of abrasion. K is a proportionality constant that is dependent upon a normal pressure ($P_N$) which, in turn, depends upon the selected area of contact (A) with the selected portion of the drill bit and the axial force on the drill bit. Therefore, equation (1) can be used to model the abrasive wear experienced by a drill bit that is drilling an earth formation.

In an embodiment of the invention, standard wear tests, such as the American Society for Testing and Materials (ASTM) standards G65 and B611, are used to test abrasion resistance of various drill bit materials, including, for example, materials used to form the bit body and cutting elements. Further, superhard materials and hardfacing materials that may be applied to selected surfaces of the drill bit may also be tested using the ASTM guidelines. The results of the tests are used to form a database of rate of wear values that may be correlated with specific materials of both the drill bit and the formation drilled, stress levels, and other wear parameters.

Iterative Design of Wear Compensated Roller Cone Drill Bits

The analysis of abrasive wear on drill bits may be incorporated into an embodiment of the invention that simulates and analyzes the performance of roller cone drill bits. A method for simulating and for analyzing the performance of roller cone drill bits drilling earth formations is described in U.S. application Ser. No. 09/524,088, filed on Mar. 13, 2000, entitled "Method for Simulating the Drilling of Roller Cone Drill Bits and its Application to Roller Cone Drill Bit Design and Performance," assigned to the assignee of the present invention, and incorporated herein by reference.

Figure 3:
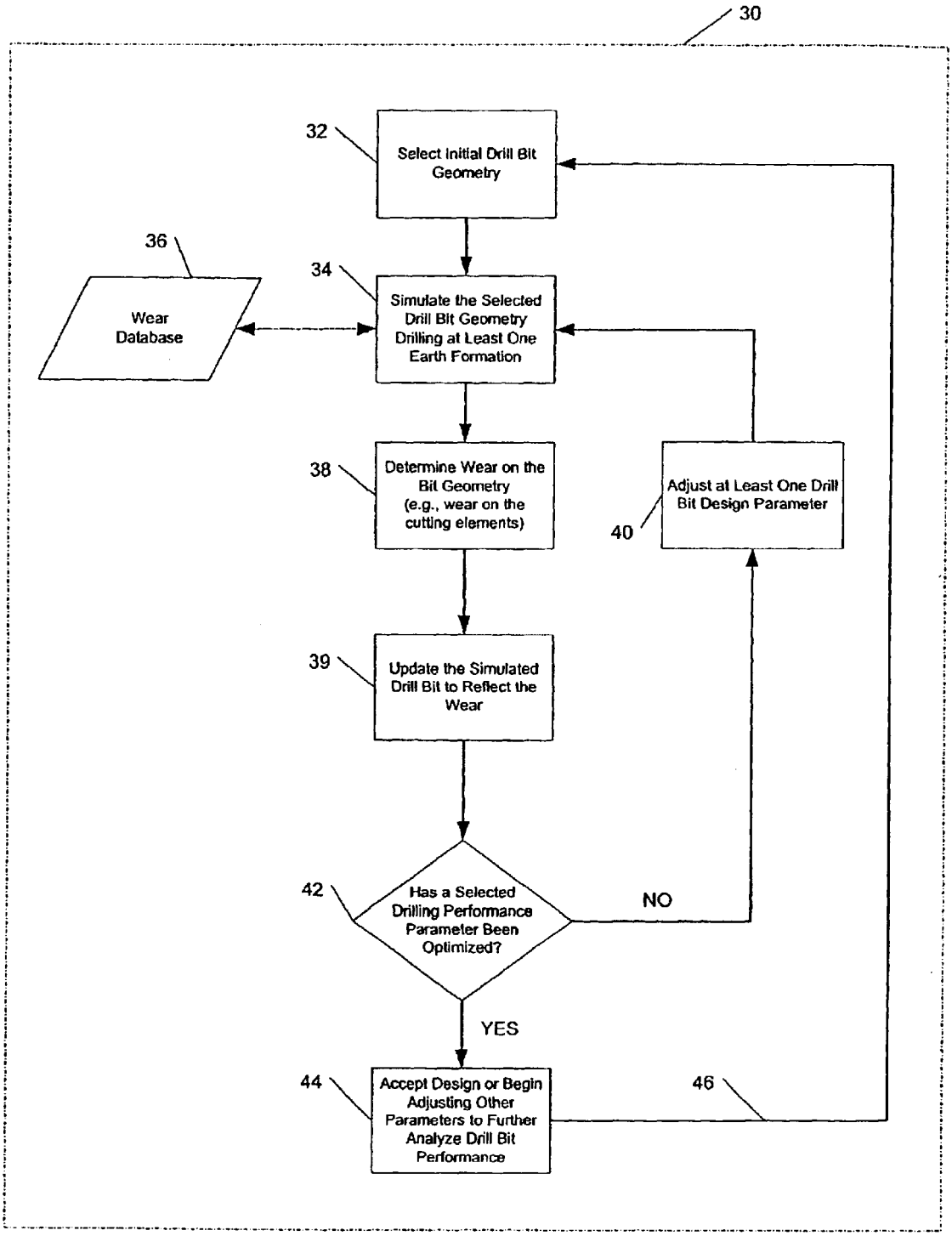
FIG. 3 shows an example of an iterative design process of an embodiment of the invention.

Referring to FIG. 3, the aforementioned simulation method 30 incorporates aspects of a drilling environment and simulates the action of the bit while drilling an earth formation. For example, the simulation method 30 calculates an axial force distribution over cutting elements disposed on a roller cone. Further, the simulation method 30 may include calculations of force distribution over surfaces of individual cutting elements. The simulation method 30 calculates other parameters, including the distribution of axial forces and/or the distribution of work performed between the roller cones. The aforementioned parameters are only a few of the drilling performance parameters that may be calculated by the simulation method and the examples are not intended to limit the scope of the invention.

An example of an iterative design process using the simulation method 30 is shown in FIG. 3. A user may select an initial drill bit geometry 32 and input the selected geometry into the simulation method 30. The simulation method 30 may then be used to simulate the drill bit drilling at least one selected earth formation 34. Both during and after the simulation 34, wear on the drill bit may be calculated 38 and incorporated into the drill bit geometry 39 (e.g., cutting element geometry may be updated to reflect wear). An analysis of the wear on the drill bit may be used to determine if, for example, selected drilling performance parameters have been optimized 42. If selected drilling performance parameters have been optimized, the user may accept the design or may choose to perform further analyses 44 by, for example, introducing additional parameters or beginning the simulation again 46 with a different initial geometry. Otherwise, the user may adjust at least one drill bit design parameter 40 and iteratively simulate 34, for example, progressive wear on the drill bit. The simulation 34 may be repeated as necessary to optimize a design.

In an embodiment of the invention, the aforementioned database 36 and equation (1) are incorporated in the drilling simulation method 30. This embodiment uses the database 36 and equation (1) to calculate additional drilling parameters that are used to determine wear experienced by a selected drill bit. For example, the simulation method calculates a normal force ($F_N$) experienced by selected parts of the bit while drilling the formation. The simulation method can then calculate an area of contact (A) between the selected parts of the bit and the formation. As a result, a normal pressure ($P_N$) may be calculated where:

$$P_N=F_N A. \quad (2)$$

$P_N$ may be used to calculate the proportionality constant (K). The area of contact (A) may be used to calculate the number (N) of wear particles in contact with the selected parts of the bit for a selected type of earth formation. The simulation can also be used to calculate the relative sliding velocity (V) between the abrasive particles (e.g., the formation) and the drill bit. After all of the these values have been calculated, the rate of wear of the selected parts of the bit may be determined using equation (1) at the selected time interval (t) and the results may be correlated to the abrasion resistance tests described above.

This embodiment, using equation (1), is used to model the effects of abrasive wear on drill bit performance. The rate of wear varies with drilling parameters such as, for example, the type of formation being drilled, drill bit revolutions per minute (RPM), and axial weight on bit (WOB). The rate of wear also varies with drill bit design parameters, including geometric and material parameters of the drill bit. Geometric parameters that may affect the rate of wear comprise a number of cutting elements, a cutting element arrangement, a number of rows of cutting elements, cutting element geometry, a number of roller cones, journal angles of roller cones, drill bit offset, and a diameter of the drill bit. Material parameters comprise a base material of the drill bit and a material from which the cutting elements are formed. For example, the cutting elements may comprise boron nitride inserts, tungsten carbide inserts, polycrystalline diamond inserts, or milled steel teeth (which may or may not be coated with a hardfacing material). Moreover, cutting elements may be formed from more than one material.

As the rate of wear of the drill bit is determined, the geometry of the modeled bit in an application of the invention may be updated to reflect changes produced by the abrasive wear. Abrasive wear information is valuable because bit performance may vary substantially continuously as the geometry of the bit changes due to wear. Accurate updates of the geometry of the simulated bit will more accurately reflect the instantaneous performance of the bit as it drills selected formations over its extended life. Observation of the simulated performance of the wear-updated bit model enables bit designers to determine how wear on various parts of the bit may affect longevity of the bit. For example, as the cutting elements of the bit begin to wear, a tooth meshing pattern of the bit will change. To simulate its performance after wear, the simulated bit having the originally designed tooth mesh pattern is replaced with a mesh pattern corresponding to worn cutting elements. As the tooth mesh pattern changes, the manner in which the bit drills the formation may change. Drilling performance parameters, such as gauge diameter of a wellbore, or rate of penetration (ROP) may be affected. The result may be a noticeable reduction in bit performance.

In addition to changes in the tooth meshing pattern, as a bit wears, an originally optimized axial force distribution may change because of wear. For example, during the design process, a drill bit design parameter may be selected to distribute axial force in a manner that optimizes drilling performance and increases bit longevity. Here, bit longevity refers to the "total life" of the drill bit defined by maximizing a length of wellbore drilled by the bit before replacement is necessary. Any change in the originally designed force distribution, for example, between roller cones, cutting elements, or rows of cutting elements, may have an adverse effect on the performance and/or the total life of the bit. By incorporating the changes in geometry resulting from wear, and by examining the results of the simulation, the bit design may be altered so that the bit wears in a predetermined, designed manner. By selectively controlling bit wear, the efficiency and ROP of the bit may be optimized over the life of the bit. For example, the cutting elements may be designed to wear substantially uniformly (e.g., the cutting elements may be designed to wear at substantially equal rates) over the life of the bit. Alternatively, the bit design may be adjusted to minimize or mitigate the adverse affects of wear. For example, an axial force distribution may be substantially maintained or balanced over the life of the bit.

To compensate for wear-induced performance degradation, the invention includes optimizing a drill bit design through iterative design testing. Various geometric properties of the bit may be iteratively modified to determine an optimum configuration that produces substantially optimized wear and/or equalized wear over the entire bit. In this aspect, "optimized wear" entails optimizing performance by, for example, maximizing the efficiency of a selected roller cone bit by arranging cutting elements to maximize ROP. Optimized wear also includes concentrating wear at specific locations, such as on specific cutting elements, to enhance the performance of the drill bit (e.g., by minimizing wear, optimizing ROP, increasing total life, etc.). "Equalized wear" refers to, in contrast, substantially equally distributing wear across an entire cutting structure of the bit. Further, equalized wear may refer to substantially equally distributing wear among cutting elements in similar positions on different roller cones. In another aspect of the invention, the number of and/or positions of rows of cutting elements may be iteratively varied to determine a configuration that optimizes bit performance as the geometry of cutting elements continually changes as a result of wear. In another aspect, drilling performance parameters of the drill bit may be optimized by determining which of the cutting elements contribute most to a performance characteristic of the bit. At least one bit design parameter is then adjusted so that the rate of wear of the selected cutting elements is minimized over the life of the bit. Typical performance characteristics comprise drill bit ROP and drill bit longevity.

In another aspect of the invention, iterative variations of the drill bit design are used to increase the durability of the drill bit. In this aspect, increasing durability refers to decreasing the wear of the bit through multiple formations. The bit may be iteratively modified to optimize performance (e.g., ROP, total life, etc.) when drilling different formations. For example, rather than designing the bit for optimum performance in only hard or soft formations, the iterative design may focus on producing a drill bit that performs well in a variety of formations in the presence of different drilling conditions (that include, for example, different formation types and different hydrostatic pressures, among other conditions). A durable drill bit is useful in a variety of formations and may reduce the number of bit changes and, as a result, the number of trips required when drilling a well.

Figure 4A:
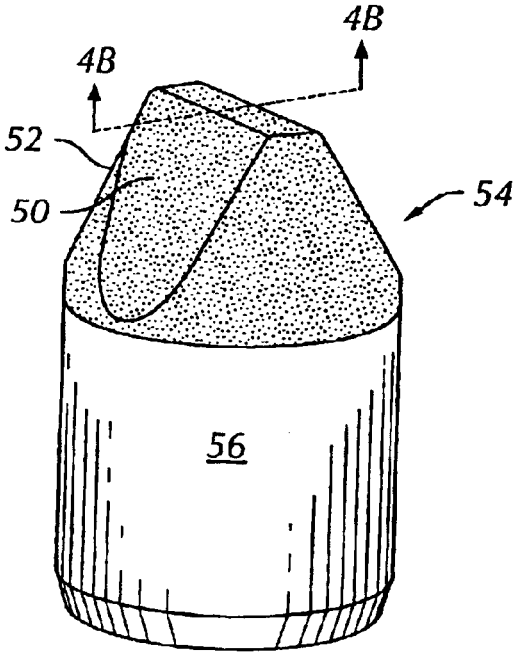
FIG. 4A shows an example of a cutting element of an embodiment of the invention.
Figure 4B:
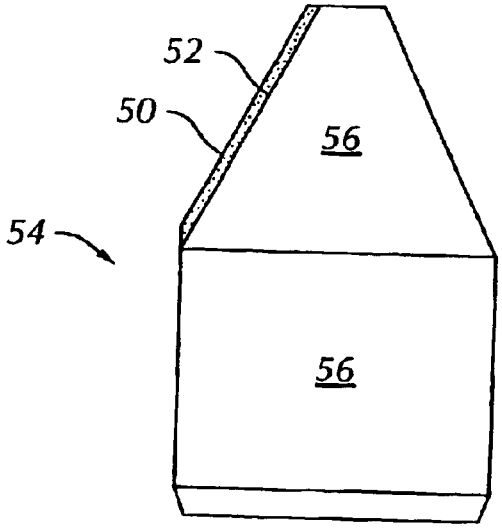
FIG. 4B shows a side view of the cutting element shown in FIG. 4A.

In another aspect of the invention, iterative design modifications may be used to select and design cutting elements. Cutting element material, geometry, and placement may be iteratively varied to provide a design that wears acceptably and that compensates, for example, for cutting element breakage. For example, iterative testing may be performed using different cutting element materials at different locations (e.g., on different surfaces) on selected cutting elements. Some cutting elements surfaces may be, for example, tungsten carbide, while other surfaces may include, for example, overlays of other materials such as polycrystalline diamond. For example, as shown in FIGS. 4A and 4B, a protective coating 50 may be applied to a surface 52 of a cutting element 54 to, for example, reduce wear. The protective coating 50 may comprise, for example, a polycrystalline diamond overlay over a base cutting element material 56 that comprises tungsten carbide.

Material selection may also be based on an analysis of a force distribution over a selected cutting element where areas that experience the highest forces or perform the most work (e.g., areas that experience the greatest wear) are coated with hardfacing materials or are formed of wear-resistant materials.

Additionally, an analysis of the force distribution over the surface of cutting elements may be used to design a bit that minimizes cutting element breakage. For example, cutting elements that experience high forces and that have relatively short scraping distances when in contact with the formation may be more likely to break. Therefore, the simulation procedure may be used to perform an analysis of cutting element loading to identify selected cutting elements that are subject to, for example, the highest axial forces. The analysis may then be used in an examination of the cutting elements to determine which of the cutting elements have the greatest likelihood of breakage. Once these cutting elements have been identified, further measures may be implemented to design the drill bit so that, for example, forces on the at-risk cutting elements are reduced and redistributed among a larger number of cutting elements.

Further, heat checking on gage cutting elements, heel row inserts, and other cutting elements may increase the likelihood of breakage. For example, cutting elements and inserts on the gage row and heel row typically contact walls of a wellbore more frequently than other cutting elements. These cutting elements generally have longer scraping distances along the walls of the wellbore that produce increased sliding friction and, as a result, increased frictional heat. As the frictional heat (and, as a result, the temperature of the cutting elements) increases because of the increased frictional work performed, the cutting elements may become brittle and more likely to break. For example, assuming that the cutting elements comprise tungsten carbide particles suspended in a cobalt matrix, the increased frictional heat tends to leach (e.g., remove or dissipate) the cobalt matrix. As a result, the remaining tungsten carbide particles have substantially less interstitial support and are more likely to flake off of the cutting element in small pieces or to break along interstitial boundaries.

Figure 5:
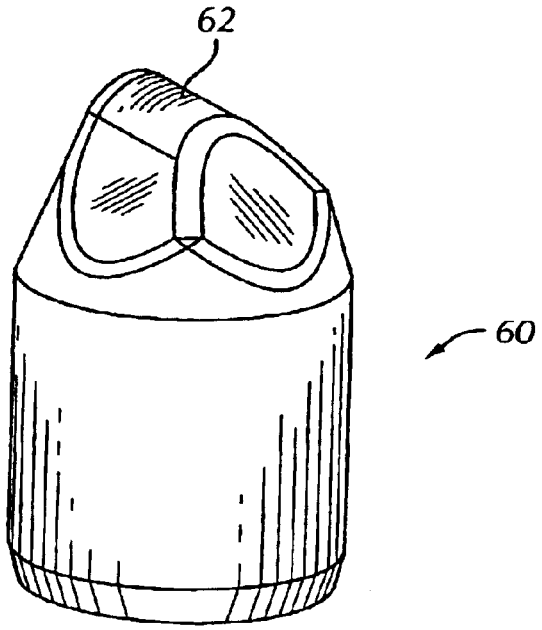
FIG. 5 shows an example of a cutting element of an embodiment of the invention.

The simulation procedure may be used to calculate forces acting on each cutting element and to further calculate force distribution over the surface of an individual cutting element. Iterative design may be used to, for example, reposition selected cutting elements, reshape selected cutting elements, or modify the material composition of selected cutting elements (e.g., cutting elements on selected roller cones, selected rows, etc.) to minimize wear and breakage. These modifications may include, for example, changing cutting element spacing, adding or removing cutting elements, changing cutting element surface geometries, and changing base materials or adding hardfacing materials to cutting elements, among other modifications. FIG. 5 shows an example of a modification of the geometry of a cutting element. For example, a cutting element 60 may have an original shape similar to the shape of the cutting element (54 in FIG. 4A) shown in FIGS. 4A and 4B. As shown in FIG. 5, the cutting element 60 may be modified to include, for example, arcuate surfaces 62. The modified cutting element geometry may, for example, reduce loading on some surfaces and/or more equally distribute forces over the cutting element 60 or between selected cutting elements.

Further, several materials with similar rates of wear but different strengths (where strength, in this case, may be defined by factors such as fracture toughness, compressive strength, hardness, etc.) may be used on different cutting elements on a selected drill bit based upon both wear and breakage analyses. Cutting element positioning and material selection may also be modified to compensate for and help prevent heat checking.

In another aspect of the invention, the distribution of axial force across the entire bit may be optimized over the life of the drill bit. Moreover, parameters such as axial force, work performed, projected cutting area, and a volume of formation cut by cutting elements may be optimized between roller cones or between cutting elements on a single cone over the life of the bit. Accordingly, any property of the bit (including the aforementioned geometric and material parameters) may be examined and optimized, and the examples provided in the application are not intended to limit the scope of the invention.

Repeated modifications made in an iterative process permit the bit designer to study how specific bit configurations wear and how bit performance is affected by wear. For example, the goal of the iterative modification of different applications of the simulation method may be to increase bit longevity and/or increase bit performance. Other applications may seek to equalize and/or optimize wear on the cutting elements or rows of cutting elements.

Iterative modification of simulated bit designs may be used to design bits that wear in a manner that optimizes, among other performance measures, a force balance or work balance between roller cones over the life of the bit. "Force balance" refers to a substantial balancing of axial force during drilling between roller cones of a drill bit. Similarly, "work balance" refers to a substantial balancing of work performed between roller cones.

The term "work" used to describe this aspect of the invention is defined as follows. A cutting element in the drill bit during drilling cuts the earth formation through a combination of axial penetration and lateral scraping. The movement of the cutting element through the formation can thus be separated into a lateral scraping component and an axial "crushing" component. The distance that the cutting element moves laterally, that is, in the plane of the bottom of the wellbore is called the lateral displacement. The distance that the cutting element moves in the axial direction is called the vertical displacement. The force vector acting on the cutting element can also be characterized by a lateral force component acting in the plane of the bottom of the wellbore and a vertical force component acting along the axis of the drill bit. The work done by a cutting element is defined as the product of the force required to move the cutting element, and the displacement of the cutting element in the direction of the force. Thus, the lateral work done by the cutting element is the product of the lateral force and the lateral displacement. Similarly, the vertical (axial) work done is the product of the vertical force and the vertical displacement. The total work done by each cutting element can be calculated by summing the vertical work and the lateral work. Summing the total work done by each cutting element on any one cone will provide the total work done by that cone. In this aspect of the invention, the numbers of, and/or placement or other aspect of the arrangement of the cutting elements on each cone can be adjusted to provide the drill bit with a substantially balanced amount of work performed by each cone.

Force balancing and work balancing may also refer to a substantial balancing of forces and work between cutting elements, rows of cutting elements, rows of cutting elements located in corresponding positions on different roller cones, or cutting elements located in corresponding positions on different roller cones. Balancing may also be performed over the entire drill bit (e.g., over the entire cutting structure or over all roller cones) over the life of the drill bit. As the bit wears, the force balance and/or wear balance may be affected by changes in the bit geometry. The invention permits bit designers to observe how the force and/or work balances of the bit are affected by bit geometry changes resulting from wear. The resulting observations can be used to make iterative modification to the initial bit geometry to optimize the force and/or work balance of the bit throughout the life of the bit.

For example, a drill bit may be designed to be substantially balanced when new. However, after experiencing substantially uniform wear while drilling at an originally optimized ROP, the drill bit may be unbalanced because of formations and/or forces experienced while drilling. As a result, it may be advantageous to design a bit that wears substantially unevenly (e.g., that has uneven wear between cutting elements or between rows of cutting elements) but that remains balanced throughout the life of the bit. The rate of wear of the drill bit may also be used to change the balance of a drill bit over the life of the bit. For example, a substantially balanced worn drill bit may drill slower (e.g., have a lower ROP) than a worn bit that is substantially unbalanced. Therefore, it may be desirable to permit the worn bit to be unbalanced so that, for example, ROP is optimized. The bit may be iteratively designed so that the level of unbalance of the worn bit is achieved in a selected manner by, for example, selectively choosing cutting element positions and/or materials.

Further, in other embodiments, the drill bit design may be optimized to have a substantially uniform, or equalized, distribution of wear across a general bit cutting structure (which comprises roller cones and cutting elements) over the life of the bit. In this embodiment, the bit has an optimized rate of wear so that each row of cutting elements wears at a selected rate over the life of the bit.

Advantageously, by incorporating the wear rate into the bit simulation, drill bits may be designed that are more efficient, have higher ROPs, and exhibit optimized wear over the life of the bit. The bits have increased longevity as the optimized designs may substantially evenly distribute wear and prevent premature drill bit failure.

Those skilled in the art will appreciate that other embodiments of the invention can be devised which do not depart from the spirit of the invention as disclosed herein. Accordingly, the scope of the invention should be limited only by the attached claims.

What is claimed is:

1. A method for designing a drill bit comprising at least one roller cone and a plurality of cutting elements arranged on the at least one roller cone, the method comprising:

selecting initial bit design parameters;

simulating drilling at least one selected earth formation with a simulated drill bit;

determining a wear induced change in geometry of the cutting elements;

changing the simulated drill bit to reflect the wear induced change in geometry of the cutting elements;

adjusting at least one bit design parameter; and repeating the simulating, determining, changing, and adjusting to improve at least one drilling performance parameter.

2. The method of claim 1, wherein the at least one drilling performance parameter comprises rate of penetration.

3. The method of claim 1, wherein the at least one drilling performance parameter comprises total life of the drill bit.

4. The method of claim 1, wherein the at least one drilling performance parameter comprises rate of penetration and total life of the drill bit.

5. The method of claim 1, wherein the at least one drilling performance parameter comprises axial force distribution over the entire drill bit.

6. The method of claim 1, wherein the at least one drilling performance parameter comprises an axial force balance between rows of cutting elements on the at least one roller cone.

7. The method of claim 1, wherein the at least one drilling performance parameter comprises an axial force balance between cutting elements on the at least one roller cone.

8. The method of claim 1, wherein the drill bit comprises a plurality of roller cones having cutting elements thereon, the at least one drilling performance parameter comprising an axial force balance between roller cones.

9. The method of claim 1, wherein the at least one drilling performance parameter comprises a distribution of work performed over the entire drill bit.

10. The method of claim 1, wherein the at least one drilling performance parameter comprises a balance of work performed between rows of cutting elements on the at least one roller cone.

11. The method of claim 1, wherein the at least one drilling performance parameter comprises a balance of work performed between cutting elements on the at least one roller cone.

12. The method of claim 1, wherein the drill bit comprises a plurality of roller cones having cutting elements thereon, the at least one drilling performance parameter comprising a balance of work performed between roller cones.

13. The method of claim 1, wherein the at least one drilling performance parameter comprises minimized cutting element breakage.

14. The method of claim 1, wherein the at least one drilling performance parameter comprises minimized cutting element heat checking.

15. The method of claim 1, wherein the at least one drilling performance parameter comprises a wear rate of the cutting elements.

16. The method of claim 1, wherein the at least one drilling performance parameter comprises durability of the drill bit.

17. The method of claim 1, wherein the at least one bit design parameter comprises a number of cutting elements on the at least one roller cone.

18. The method of claim 1, wherein the at least one bit design parameter comprises a number of roller cones.

19. The method of claim 1, wherein the at least one bit design parameter comprises a number of rows of cutting elements on the at least one roller cone.

20. The method of claim 1, wherein the at least one bit design parameter comprises a location of cutting elements on the at least one roller cone.

21. The method of claim 1, wherein the at least one bit design parameter comprises a location of rows of cutting elements on the at least one roller cone.

22. The method of claim 1, wherein the at least one bit design parameter comprises a material from which the plurality of cutting elements are formed.

23. The method of claim 1, wherein the at least one bit design parameter comprises cutting element geometry.

24. The method of claim 1, wherein the at least one bit design parameter comprises an arrangement of materials on at least one cutting element adapted to wear in a selected manner.

25. The method of claim 1, wherein the at least one bit design parameter comprises an arrangement of materials on at least one cutting element adapted to reduce breakage thereof.

26. The method of claim 1, wherein the at least one bit design parameter comprises an arrangement of materials on at least one cutting element adapted to reduce heat checking thereof.

27. The method of claim 1, wherein the at least one bit design parameter comprises an arrangement of different materials on adjacent cutting elements.

28. The method of claim 1, wherein the at least one bit design parameter comprises an arrangement of different materials on different rows of cutting elements.

29. The method of claim 1, wherein the at least one bit design parameter comprises a hardness of a cutting element material.

30. The method of claim 1, wherein the at least one bit design parameter comprises a compressive strength of a cutting element material.

31. The method of claim 1, wherein the at least one bit design parameter comprises a fracture toughness of a cutting element material.

32. The method of claim 1, wherein determining wear further comprises:

calculating a force normal to a selected area of a drill bit;

calculating a number of wear particles in contact with the selected area;

calculating a normal pressure by dividing the normal force by the selected area;

calculating a relative sliding velocity; and calculating the rate of wear by determining a product of the number of wear particles, the relative sliding velocity, and a selected time increment.

33. The method of claim 1, further comprising repeating the simulating, determining, changing, and adjusting until at least one drilling performance parameter is optimized over the life of the drill bit.

34. A method for designing a drill bit comprising at least one roller cone and a plurality of cutting elements arranged on the at least one roller cone, the method comprising:

simulating drilling at least one selected earth formation with a simulated drill bit;

determining a wear induced change in geometry of the cutting elements;

changing the simulated drill bit to reflect the wear induced change in geometry of the cutting elements;

determining which of the cutting elements contribute most to a performance characteristic of the drill bit; and adjusting at least one drill bit design parameter so as to minimize the rate of wear of the cutting elements which most contribute over the life of the drill bit.

35. The method of claim 34, wherein the performance characteristic comprises a volume of formation cut by cutting elements on the at least one roller cone.

36. The method of claim 34, wherein the performance characteristic comprises axial force on the at least one roller cone.

37. The method of claim 34, wherein the performance characteristic comprises work performed by the at least one roller cone.

38. The method of claim 34, wherein the performance characteristic comprises a rate of penetration of the drill bit.

39. The method of claim 34, wherein the performance characteristic comprises a total life of the drill bit.

* * * * *

UNITED STATES PATENT AND TRADEMARK OFFICE

CERTIFICATE OF CORRECTION

PATENT NO. : 6,856,949 B2
DATED : February 15, 2005
INVENTOR(S) : Sujian J. Huang It is certified that error appears in the above-identified patent and that said Letters Patent is hereby corrected as shown below:

Title page,
Item [63], Related U.S. Application Data, change "Continuation of application No. 09/775,530, filed on Jan. 31, 2001, now Pat. No. 6,619,444" to -- Continuation of application No. 09/775,530, filed on Jan. 31, 2001, now Pat. No. 6,619,411 --.

Signed and Sealed this

Seventh Day of June, 2005

JON W. DUDAS
*Director of the United States Patent and Trademark Office*